United States Patent [19]

Hazenveld

[11] 4,223,817

[45] Sep. 23, 1980

[54] GARMENT HANGER

[76] Inventor: Martin G. Hazenveld, P.O. Box 90, 5750 AB Deurne, Netherlands

[21] Appl. No.: 11,655

[22] Filed: Feb. 12, 1979

[30] Foreign Application Priority Data

Feb. 17, 1978 [GB] United Kingdom ..... 6453/78

[51] Int. Cl.[2] ..... A47J 51/10

[52] U.S. Cl. ..... 223/94

[58] Field of Search ..... 223/94, 95, 96, 87

[56] References Cited

U.S. PATENT DOCUMENTS

| | | | |
|---|---|---|---|
| 437,390 | 9/1890 | Wynan | 223/95 |
| 2,421,071 | 5/1947 | Kraft | 223/95 |
| 2,545,637 | 3/1951 | Tibbitts | 223/95 |
| 3,445,045 | 5/1969 | Panning | 223/95 |
| 3,531,028 | 9/1970 | Vazquez | 223/94 |

FOREIGN PATENT DOCUMENTS

| | | | |
|---|---|---|---|
| 477167 | 6/1929 | Fed. Rep. of Germany | 223/95 |
| 465457 | 9/1951 | Italy | 223/95 |
| 526133 | 9/1940 | United Kingdom . | |
| 679598 | 9/1952 | United Kingdom . | |
| 1514978 | 6/1978 | United Kingdom . | |

*Primary Examiner*—George H. Krizmanich
*Attorney, Agent, or Firm*—John P. Snyder

[57] ABSTRACT

A garment hanger having a central body provided with a suspension hook, and on each side of this central body, one above the other, two or more parallel, upwardly inclined tensioning arms having their free ends interconnected by a common cross-arm. All of the tensioning arms are connected to the central body and to their corresponding cross-arm by means of hinged junctions, and spring means are present for urging the tensioning arms to their initial position after any change of position.

4 Claims, 6 Drawing Figures

GARMENT HANGER

Figure 1:
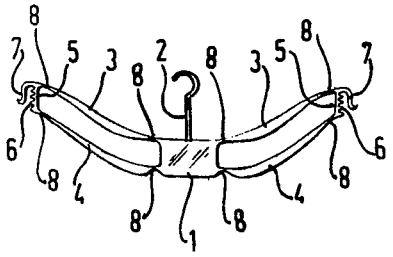

This invention relates to a garment hanger which has been devised predominantly for suspending skirts and similar garments but which may also be used with advantage for suspending other articles of manufacture.

A known hanger for this purpose has a central triangular body provided with a suspension hook, and on each side of this body an upwardly inclined tensioning arm which is connected to the small base of the central body by means of a spring junction. This garment hanger may be used by introducing it into a garment when its arms are in raised position, and then releasing the tensioning arms so as to allow them to stretch and to engage the garment. A further stretching of the arms and consequently the exertion of a garment tensioning force is brought about by the weight of the garment, whereupon the combination of garment and hanger may be stored at any desired place.

An advantage of this known hanger is that it may be manufactured at low price. On the other hand, it is capable only of carrying limited weights of garments. A disadvantage is, moreover, that the bearing surfaces at the free ends of the tensioning arms will always take different positions with varying garment diameters.

The invention has for its object to provide an improved garment hanger which does not have the aforesaid disadvantages.

The invented garment hanger comprises a central body provided with a suspension element, and on each side of this central body, one above the other, two or more parallel, upwardly inclined tensioning arms having their free ends interconnected by a common cross-arm, all of said tensioning arms being connected to the central body and to their corresponding cross-arm by means of hinged junctions and spring means being present for urging the said tensioning arms to their initial position after any change in position.

This invented hanger may be used in the same way as the known hanger, by inserting it into a garment when its tensioning arms are in raised position, and then releasing the arms so as to allow them to stretch and to engage the garment. As an alternative, loops of the garment may be fastened to hooks at or near the ends of the cross-arms when the tensioning arms are in raised position, and then the tensioning arms may be released so as to allow them to stretch. In both ways of use, the weight of the garment will bring about a further stretching of the arms and consequently the exertion of a garment tensioning force, whereupon the combination of garment and hanger may be stored in any desired place.

Thanks to a higher number of tensioning arms on each side of the hanger, and to the fact that these tensioning arms are interconnected by cross-arms, the invented hanger is capable of bearing higher garment weights. Yet its manufacturing costs have not been much increased. The hinged junctions together with the spring means provide for a high resilience in the hanger, thus allowing a high tensioning force to be exerted on the garments. Moreover, the hanger may well be used for garments of varying diameters. The cross-arms on each side of the hanger will act as bearing surfaces for the garments and will always remain in the same (preferably vertical) position since they form hinged parallelograms with the adjoining tensioning arms and the central body; this results in optimum tensioning of the suspended garments, no matter what their weight or diameter might be.

The number of tensioning arms on each side of the central body may be two or three or more, dependent from the desired loading capacity of the invented hanger. Further, the central boy may have any shape and dimensions; this will be clear from embodiments discussed lateron.

The aforesaid spring means are necessary to provide the required resilience and the required tensioning force and may be realised in different ways. In an advantageous embodiment, at least one of the hinged junctions, and preferably all of them, is/are formed as spring junctions. This can be realised very simply by manufacturing the hanger of a synthetic resin and forming thinner portions of material at the place of the junctions. Further, one or more tension springs or other springs may be arranged adjacent to or in the hinged or spring junctions, as an alternative to the justmentioned feature.

Reference is now made to the drawings which show some embodiments of the invented hanger by way of example.

Figure 3:
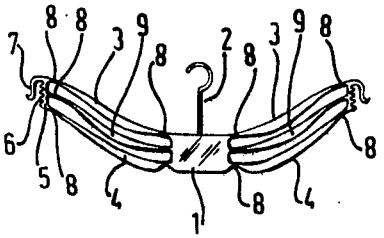
Figure 5:
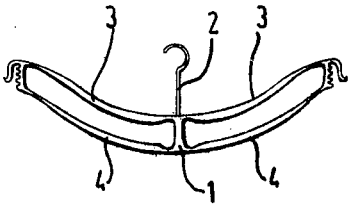

FIGS. 1 and 3 and 5 show three embodiments of the garment hanger according to the invention.

Figure 2:
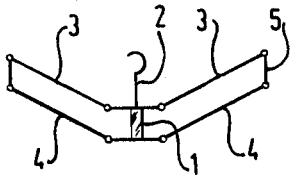
Figure 4:
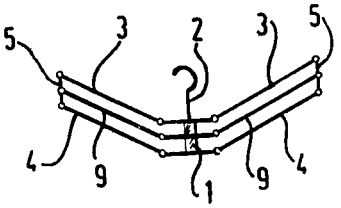
Figure 6:
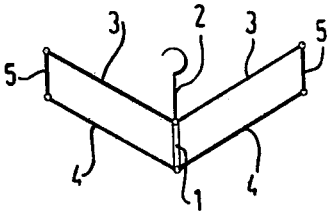

FIGS. 2 and 4 and 6 illustrate the principle of the garment hangers of FIGS. 1 and 3 and 5, respectively in a diagrammatical way.

A first embodiment of the invented hanger is shown in FIG. 1. This embodiment has a central body 1 provided with a suspension hook or element 2. On each side of the central body 1, one above the other, are two parallel, upwardly inclined tensioning arms 3,3 and 4,4 which have their free ends interconnected by cross-arms 5,5. These cross-arms 5,5 are destined to carry a skirt or other garment and to this purpose, they have been provided with bearing surfaces 6,6 and stops 7,7. All junctions 8,8 between the tensioning arms 3,3,4,4 on one hand and the central body 1 and cross-arms 5,5 at the other hand are spring junctions, thus providing at the same time for hinged connections and for spring means urging the tensionign arms to their intitial position after any change.

The hanger may be used by inserting it into a garment when its tensioning arms are in raised position, and then releasing the tensioning arms so as to allow them to stretch and allow the cross-arms to engage the garment. The weight of the garment will then bring about a further stretching of the tensioning arms and the exertion of a certain tensioning force upon the garment.

It will be clear that the embodiment of FIG. 1 will have a higher loading capacity than an embodiment with only one tensioning arm on each side, as in the known hanger. Yet its manufacturing costs have not been increased substantially, thanks to the relatively simple construction. The high number of spring junctions provides for a high resilience and consequently for a high tensioning force and will ensure that the hanger may be used for garments of varying diameters since they always tend to urge the tensioning arms towards their initial position.

FIG. 2 is a diagram of the same garment hanger of FIG. 1 and shows an important principle thereof. It can be seen here that each cross-arm 5 forms a hinged parallelogram with the adjoining tensioning arms 3 and 4 and with the central body 1. The central body will always remain stationary and this means that, whatever position the tensioning arms will assume during use, the cross-arms will always remain in the same (vertical)

position. As a result thereof, the bearing surfaces always remain vertical and will engage the garments in a proper fashion.

The embodiment of FIG. 3 differs from the embodiment of FIG. 1 only by the use of three tensioning arms 3,4,9, one above the other, on each side of a central body 1. It is used in the same way as the embodiment of FIG. 1 and has a still higher loading capacity. FIG. 4 shows that each cross-arm 5 will form a double hinged parallelogram with the adjoining tensioning arms 3,4,9 and with the central body 1, and this means that the bearing surfaces on such cross-arm 5 will always remain in the same vertical position, no matter what position the tensioning arms assume. Thus, the bearing surfaces will engage the garments always in the same proper fashion.

The embodiment of FIG. 5 is similar to that of FIG. 1, but the central body 1 has been made very small so as to save the bulk of material. In this case, the tensioning arms 3,3 and 4,4 on either side of the central body are nearly connected with each other. FIG. 6 shows however, that the principle remains the same.

Many variants to the embodiments as shown are possible. Thus, the junctions between the tensioning arms and the other parts need not always be spring junctions. It is possible to realise all of these junctions as simple hinged junctions and to arrange one or more tension springs or other springs or combinations thereof adjacent thereto or therein. Nevertheless, the use of at least one spring junction has certain advantages because such a spring junction may simply be realised by contraction of the part in question when the whole garment hanger is manufactured from synthetic resin. Preferably, all hinged junctions are spring junctions like shown in the drawing.

Other possible variants relate to the bearing surfaces 6,6 and stops which may be replaced with the same advantages by bearing, engaging and/or stop means of other shape or combined therewith. Thus, it is possible to provide the cross-arms 5,5 with hooks or eyelets which may serve to engage loops on the garments to be stored. Such hooks may be used in stead of or in addition to the bearing surfaces 6,6. During utilisation of this variant, the tensioning arms are raised first, whereupon the loops of a garment are fastened to the said hooks or eyelets and the tensioning arms are released. The tensioning arms will stretch themselves then and the hooks or eyelets on the cross-arms will exert a tensioning force onto the garment, whereafter the combination of a hanger and garment may be stored at any desired place.

Stop means may be arranged on each side of the central body to prevent any excessive downward bending of the tensioning arms.

Further, the suspension hook 2 may be replaced by any other suspension element.

Finally, it is remarked that the garment hanger of the invention is not only suitable for suspending garments in tensioned state but also suitable for suspending dress covers, bags and other articles of manufacture.

What we claim is:

1. A garment hanger comprising a central body, a first pair of parallel upwardly inclined tensioning arms disposed at one side of said central body, said tensioning arms each having ends adjacent to and remote from said central body, a cross arm disposed at said remote tensioning arm ends, first, second, third and fourth means for respectively hingedly connecting a first of said tensioning arm adjacent ends and a second of said tensioning arm adjacent ends to said central body and a first of said tensioning arm remote ends and a second of said tensioning arm remote ends to said cross arm, a second pair of parallel upwardly inclined tensioning arms disposed at a side of said central body opposite said one side, said second pair of tensioning arms each having ends adjacent to and remote from said central body, another cross arm disposed at said second pair of tensioning arm remote ends, fifth, sixth, seventh and eighth means for respectively hingedly connecting a first of said second pair of tensioning arm adjacent ends and a second of said second pair of tensioning arm adjacent ends to said central body and a first of said second pair of tensioning arm remote ends and a second of said second pair of tensioning arm remote ends to said another cross arm, means connected directly to only said central body for suspending said hanger from a suitable support, said first and second pair of tensioning arms being movable about said first through eight hingedly connecting means between a first position more adjacent said suspending means and a second position more remote from said suspending means, and means defined by the natural resilience of the material of said hanger for spring biasing said tensioning arms from said first position toward but not beyond said second position whereby said cross arms will be disposed at a maximum spaced distance from each other less than what the distance would be if said first and second pairs of tensioning arms were not inclined and were in general alignment with each other.

2. The garment hanger as defined in claim 1 wherein said spring biasing means and said first through eight hingedly connecting means are one in the same whereby the natural resilience of said first through eight hingedly connecting means spring bias said tensioning arms as aforesaid.

3. The garment hanger as defined in claim 1 wherein each of said cross arms includes a generally downwardly opening hook defined by a bight portion and a downwardly projecting terminal stop spaced by a gap from a bearing surface.

4. The garment hanger as defined in claim 2 wherein each of said cross arms includes a generally downwardly opening hook defined by a bight portion and a downwardly projecting terminal stop spaced by a gap from a bearing surface.

* * * * *